US012012237B2

(12) United States Patent
Ceré et al.

(10) Patent No.: US 12,012,237 B2
(45) Date of Patent: Jun. 18, 2024

(54) METHOD AND APPARATUS FOR WRAPPING

(71) Applicant: AETNA GROUP S.P.A., Verucchio (IT)

(72) Inventors: Mauro Ceré, Verucchio (IT); Gabriele Canini, Verucchio (IT)

(73) Assignee: AETNA GROUP S.P.A., Verucchio (IT)

( * ) Notice: Subject to any disclaimer, the term of this patent is extended or adjusted under 35 U.S.C. 154(b) by 145 days.

(21) Appl. No.: 17/796,557

(22) PCT Filed: Jan. 29, 2021

(86) PCT No.: PCT/IB2021/050704

§ 371 (c)(1),
(2) Date: Jul. 29, 2022

(87) PCT Pub. No.: WO2021/152522

PCT Pub. Date: Aug. 5, 2021

(65) Prior Publication Data

US 2023/0049546 A1 Feb. 16, 2023

(30) Foreign Application Priority Data

Jan. 31, 2020 (IT) ..... 102020000001984

(51) Int. Cl.

| | |
|---|---|
| ***B65B 11/04*** | (2006.01) |
| ***B65B 11/54*** | (2006.01) |
| ***B65B 41/16*** | (2006.01) |
| ***B65B 51/16*** | (2006.01) |
| *B65B 11/00* | (2006.01) |

(52) U.S. Cl.

CPC ..... *B65B 11/54* (2013.01); *B65B 11/045* (2013.01); *B65B 41/16* (2013.01); *B65B 51/16* (2013.01); *B65B 2011/002* (2013.01); *B65B 2210/14* (2013.01)

(58) Field of Classification Search

USPC ..... 53/461

See application file for complete search history.

(56) References Cited

U.S. PATENT DOCUMENTS

| | | | | |
|---|---|---|---|---|
| 4,807,427 | A * | 2/1989 | Casteel | B65B 11/006 53/389.2 |
| 4,905,451 | A * | 3/1990 | Jaconelli | B65D 65/22 53/410 |
| 5,447,009 | A * | 9/1995 | Oleksy | B65B 11/045 53/399 |
| 10,131,510 | B2 | 11/2018 | Nützel | |
| 2011/0088359 | A1* | 4/2011 | Brocard | B65B 11/585 53/461 |
| 2016/0251177 | A1 | 9/2016 | Nützel | |
| 2023/0312149 | A1* | 10/2023 | Bison | B65B 11/58 53/399 |

* cited by examiner

*Primary Examiner* — Chinyere J Rushing-Tucker

(74) *Attorney, Agent, or Firm* — Wenderoth, Lind & Ponack, L.L.P.

(57) ABSTRACT

A method for wrapping a load with a film, strip, band of extensible material comprises: unwinding a film of extensible material from a reel; making a pleat on the film by means of a pleating system; stretching the film by means of a pair of pre-stretching rollers; welding the pleat by means of at least one of the pre-stretching rollers; wrapping the load with the film provided with the pleat.

13 Claims, 3 Drawing Sheets

METHOD AND APPARATUS FOR WRAPPING

The invention relates to apparatuses and methods for wrapping a load with a film or web or strip of material, for example plastic material.

It is known in the packaging industry to wrap with a film, generally made of cold extensible plastic material, a load formed by a single product or by a plurality of products grouped on a pallet.

In particular, the known wrapping machines comprise an unwinding apparatus which is movable along and/or around a wrapping axis and which supports a reel of film from which the film is unwound to be wrapped around the load so as to form a series of strips or bands generally having a helical trend, by virtue of the combination of the relative linear and rotational movements between the unwinding apparatus and the load.

In wrapping machines provided with a rotating table that supports the load, during the wrapping process the load is rotated around a vertical wrapping axis, while the unwinding apparatus is moved parallel to the wrapping axis with alternating motion along a fixed upright of the wrapping machine.

In wrapping machines with horizontal rotating ring or with rotating arm, the load remains static during the wrapping, while the unwinding apparatus is moved with respect to the load both in rotation around a vertical wrapping axis and in translation along the vertical wrapping axis. To this end, the unwinding apparatus is fixed to a ring structure or to an arm rotatably that are supported by a machine frame and so as to rotate around the load.

In wrapping machines with a vertical rotating ring the load is moved horizontally through the ring, while the unwinding apparatus fixed to the ring is rotated around a horizontal axis.

The unwinding apparatus is generally provided with a pair of pre-stretching rollers, comprising a slow roller and a fast roller, respectively upstream and downstream with reference to the movement of the film, to stretch and unwind the film, and one or more guiding rollers to divert the film towards the load during the unwinding.

By appropriately adjusting the difference between the rotational speeds of the two pre-stretching rollers, it is possible to stretch or elongate by a defined amount, according to a set pre-stretching or extension percentage, the film exiting the unwinding apparatus before it is wrapped around the load.

In particular, the film is stretched before being wrapped around the load since the stretching, or elongation, allows the best use of the film and gives the latter physical-mechanical features such as to make it more suitable to withstand the forces acting on the load during the subsequent handling and transport. In particular, when the stretching force ceases, the elastic return of the film determines a clamping force on the load which ensures the containment thereof.

The stretching is generally expressed as a percentage of the ratio between the elongation of the film (difference between the final length of the stretched film and the original length) and the original length. Typically the elongation imparted to the film is between 50 and 300%.

As is known, the stretching or pre-stretching force of the rollers allows to considerably reduce the thickness of the film (typically from about 25-20 μm to about 6-7 μm) so as to proportionately increase the length thereof to wrap a greater load perimeter with the same initial amount of unwound film.

The pre-stretching force exerted by the pre-stretching rollers also allows to change the mechanical features of a film typically made of plastic material. The appropriately stretched material of the film may change from an elastic behaviour, in which the film tends to recover its original dimension upon cessation of the stress, to a substantially plastic behaviour, in which the film undergoes a permanent deformation and does not fully recover its initial dimension upon cessation of the stress. In the latter case, the plastic film considerably reduces its elastic return capacity and behaves as a flexible and substantially inextensible element, similar to a rope or belt, and can be used, for example, to wrap groups of unstable products which must be held firmly together.

The pre-stretching force to which the film is subjected to obtain a certain elongation ratio or percentage depends on a number of factors: initial film thickness, physical-mechanical features of the plastic material of the film (type of material, composition, quantity and distribution of any internal impurities and inhomogeneities), environmental conditions (temperature, humidity) in which the load is wrapped.

Although it is known that films of the same material and of the same nominal thickness belonging to different reels must be subjected to different pre-stretching forces to obtain similar elongation ratios and above all to avoid an excessive thinning which would make the film unsuitable for a correct wrapping of the load and/or more subject to tears and breakage, nonetheless the tears and breakage occur frequently during the wrapping cycles.

In fact, variations in the physical-mechanical features of the film and, above all, in the thickness thereof can often also be found in the same film reel during the unwinding thereof. For example, depending on the production processes of the plastic film, generally linear low-density polyethylene, it is in fact possible to have films with different homogeneity and thickness uniformity. The thickness starting from a nominal value between 20-25 μm, may vary by ±10-20%.

Ambient conditions, in particular the temperature, also significantly affect the performance of the stretched film. In more detail, at lower temperatures the film lengthens and deforms with greater difficulty and, at the same pre-stretch ratio, can tear and break more easily and more frequently. The temperature of the film is also dependent on the operating conditions, in particular it increases with the increase of the film wrapping speed and the stretching ratio.

There are therefore a number of environmental and operational factors which cause excessive thinning, tears and even breakage of the film during the operation of the wrapping machines, especially in the case of high stretching ratios. Such drawbacks result in incorrectly wrapped loads or stops in the production and in the wrapping machine to proceed with the replacement of the film reel, as well as a waste of plastic material both in the case where the film is excessively thinned or torn and additional plastic film must be used to reinforce the thinning or tearing areas, and in the case where the film is broken, therefore unusable, and must be completely replaced.

Tears and breakage of the film also occur in the case of wrapping irregular loads, provided with edges, protruding and sharp portions and the like. Tears and rips of the film can also propagate on the film and lead to complete breakage of the film both during wrapping (typically in the case of high stretching ratios) and after wrapping, following the handling and transport of the load.

EP 0300855 describes a method and a device for continuously making a longitudinal reinforcement on a plastic film. The film is advanced along a longitudinal direction and in a folding step at least two adjacent longitudinal zones of the film are folded flat on top of each other so as to form a longitudinal pleat which forms a respective longitudinal reinforcing zone.

It is an object of the invention to improve the known methods for wrapping a load with a film or strip or band or the like of extensible material, for example plastic material, and the known unwinding apparatuses associated with wrapping machines for wrapping a load with a film or strip or band or the like of extensible material.

Another object is to provide an unwinding method and an unwinding apparatus associable with a wrapping machine which allow any type of load to be wrapped firmly and compactly, reducing and virtually eliminating the risk of breakage of the film, strip, band during the wrapping.

Another object is to provide an unwinding method and an unwinding apparatus which allow high versatility and flexibility of the wrapping cycles.

Another object is to provide an unwinding method and an unwinding apparatus which allows to optimize, in particular reduce, the amount of material used to wrap any type of load firmly and compactly.

In a first aspect of the invention a method for wrapping a load according to claim 1 is provided.

In a second aspect of the invention an unwinding apparatus associable with a machine for wrapping a load according to claim 4 is provided.

The invention can be better understood and implemented with reference to the attached drawings which illustrate exemplifying and non-limiting embodiments thereof, in which.

Figure 1:
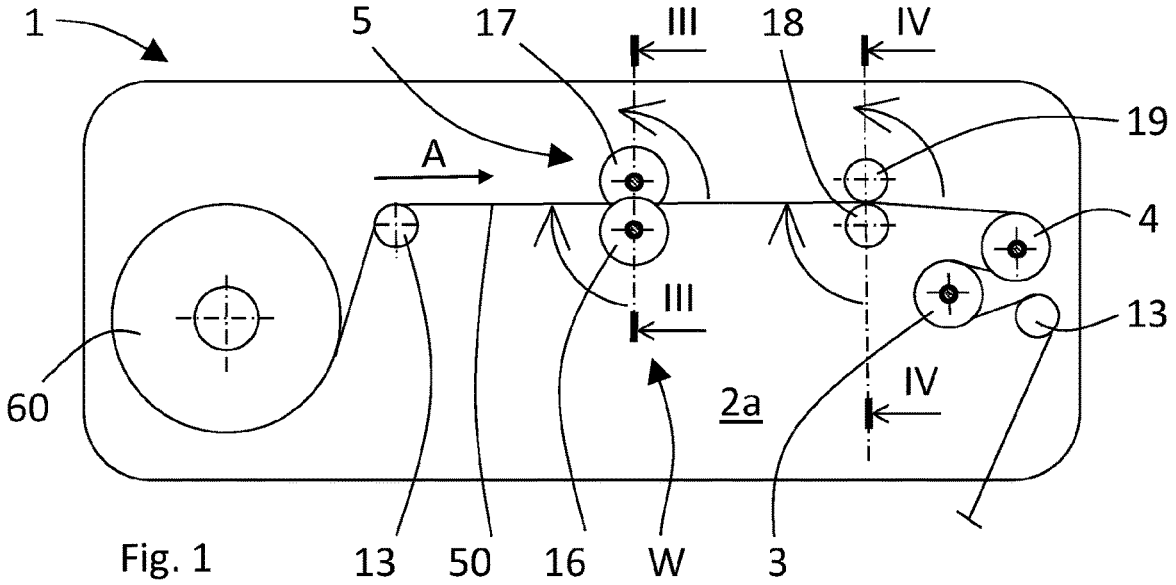
FIG. 1 is a schematic plan view from above of the film unwinding apparatus of the invention.
Figure 2:
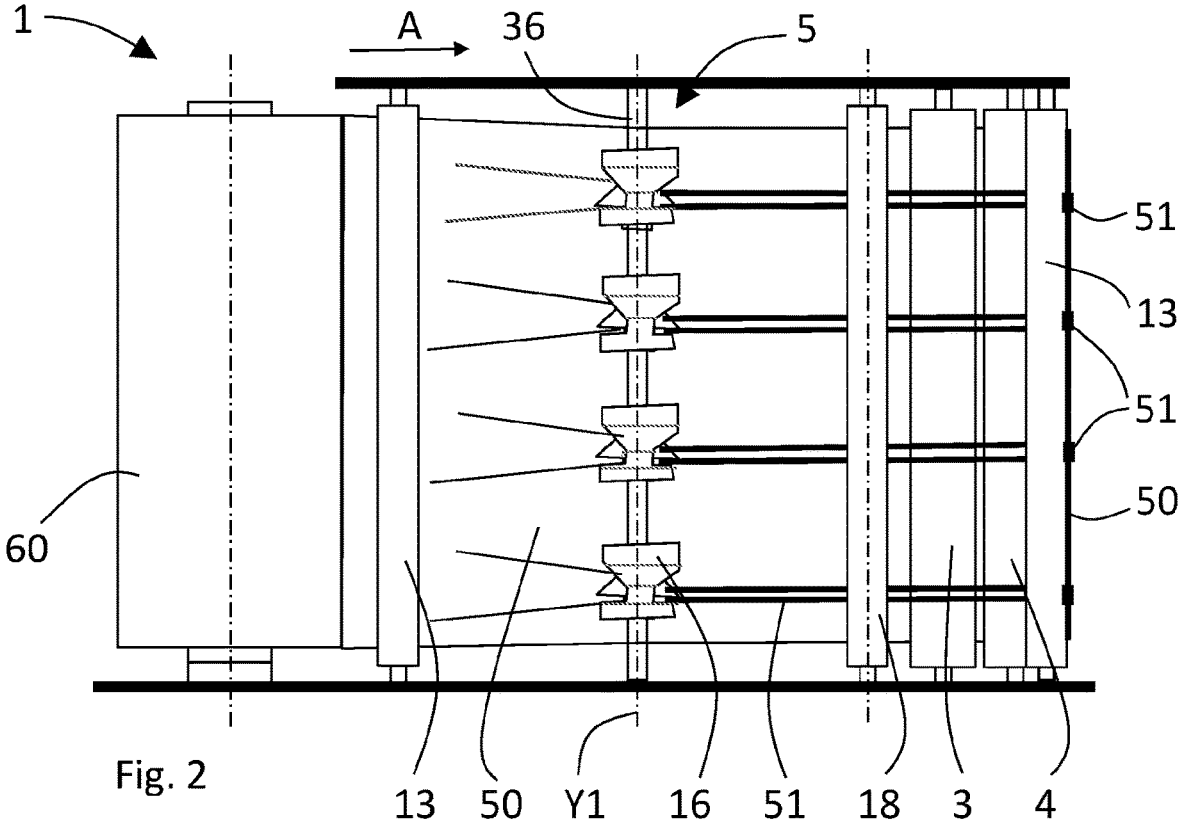
FIG. 2 is a frontal schematic view of the unwinding apparatus of FIG. 1.
Figure 4:
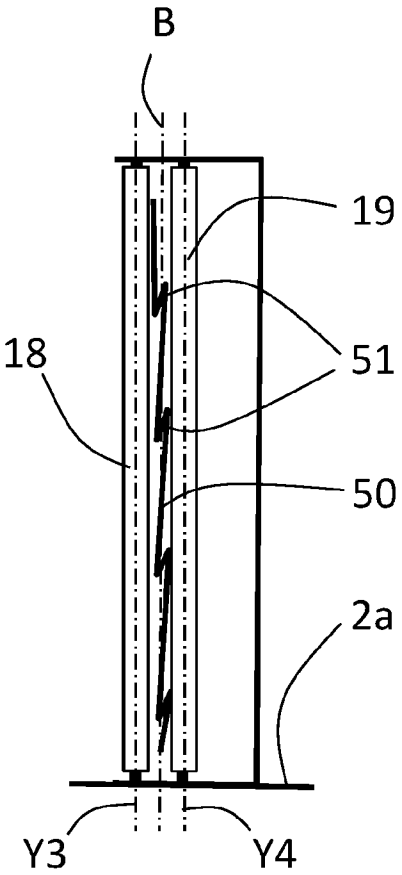
FIG. 4 is a section along the plane IV-IV of FIG. 1 illustrating pressure rollers acting on the film of extensible material.

FIG. 1 shows the unwinding apparatus 1 of the invention associable with a wrapping machine 100 for wrapping with a film 50 or strip or band or the like of cold extensible material a load, not shown, for example formed by one or more products grouped on a pallet. The film 50 can be a film of plastic material or a film or strip or band of material based on paper and cellulose derivatives, based on fabrics, or a composite film of plastic material and mineral salts and/or compounds.

The wrapping machine 1 can be, for example, of the rotatable type, known and therefore not illustrated and described, provided with a table or platform capable of supporting and rotating the load around a vertical axis.

The unwinding apparatus 1 comprises supporting means 2 for supporting a reel 60 of the film 50 and a first pre-stretching roller 3 and a second pre-stretching roller 4 cooperating to unwind the film 50 from the reel 60 and pre-stretch the film. The pre-stretching rollers 3, 4 are rotated about respective longitudinal axes, for example by an electric motor and a motion reduction and transmission assembly, or alternatively, by respective electric motors, known and none of which is illustrated in the figures. The first pre-stretching roller 3, called the fast roller, which is located downstream of the second pre-stretching roller 4, called the slow roller, with respect to the movement of the film 50, rotates about the respective longitudinal axis faster than the second pre-stretching roller 4 (rotatable about the respective longitudinal axis) so as to pre-stretch the film 50 by a defined amount or percentage.

The unwinding apparatus 1 further comprises one or more return rollers 13, parallel to the pre-stretching rollers 3, 4 and arranged for example to deflect the film 50 from the reel 60 to the first pre-stretching roller 3 and the second pre-stretching roller 4 and to engage and deflect the film 50 exiting from the pre-stretching rollers 3, 4 towards the load.

The unwinding apparatus 1 further comprises a pleating system 5 located downstream of the reel 60 and upstream of the pre-stretching rollers 3, 4 with respect to a movement direction A of the film 50 and configured to carry out one or more pleats 51, on the film 50. The pleats 51 are parallel to the movement direction A.

One or both of the pre-stretching rollers 3, 4 are further heatable, in particular at a defined temperature, so as to weld the pleats 51 and thus create on the film 50 respective longitudinal reinforcing strips which increase the resistance to tensile stress of the film 100 and prevent propagation in the transverse direction (to the movement direction A) of cuts, rips, tears and therefore the partial or complete breakage of the film. Then the pre-stretching rollers 3, 4 simultaneously stretch the film 50 and weld the pleats 51.

Figure 3:
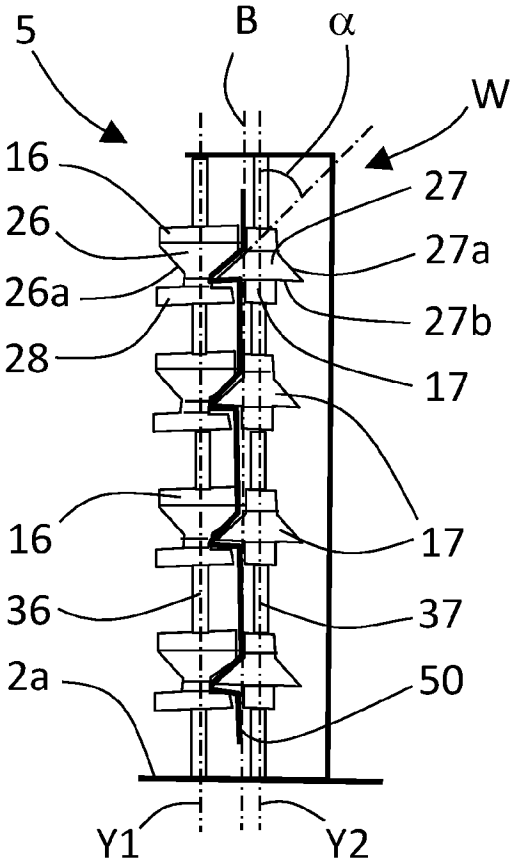
FIG. 3 is a section along the plane III-III of FIG. 1 illustrating a pleating system acting on a film of extensible material.

With particular reference to FIG. 3, the pleating system 5 comprises at least a first pleating roller 16 and a second pleating roller 17 mounted respectively on a first supporting shaft 36 and a second supporting shaft 37 facing each other. The first supporting shaft 36 and the second supporting shaft 37 are rotatable about respective longitudinal axes Y1, Y2 that are parallel to each other and to a movement plane B of the film 50; the movement plane B is substantially orthogonal to a supporting plane 2*a* of the supporting means 2 and parallel to the movement direction A.

The first pleating roller 16 and the second pleating roller 17 have respective truncated conical portions 26, 27 configured and arranged to be in contact with, and engage, each other in an operating configuration W of the pleating system 5 so as to press and fold the film 60 which is moved through the pleating rollers 16, 17 thereby making a pleat 51. In particular, the first pleating roller 16 and the second pleating roller 17 form two folds and overlap three longitudinal sections of the film 50.

More precisely, the first pleating roller 16 comprises a first truncated conical portion 26 converging towards the supporting plane 2*a* of the supporting means 2, while the second pleating roller 17 comprises a second truncated conical portion 27 converging in the direction opposite the supporting plane 2*a*.

The truncated conical portions 26, 27 of the pleating rollers 16, 17 comprise respective external walls 26*a*, 27*a* which are inclined by a pleating angle $\alpha$ (acute angle) with respect to the movement plane B. The pleating angle $\alpha$ has a value comprised, for example, between 30° and 70°.

The first pleating roller 16 further comprises an annular protrusion 28, which forms in particular a disc and is configured to abut a side wall 27*b* of the second truncated conical portion 27 of the second pleating roller 17 so as to press and fold the film 50 against said side wall 27*b*.

In the illustrated embodiment, the pleating system 5 comprises a plurality of first pleating rollers 16, for example four, and a corresponding plurality of second pleating rollers 17 mounted respectively on the first supporting shaft 36 and on the second supporting shaft 36, 37 and arranged to make a respective plurality of pleats 51 on the film 50.

The number of pairs of pleating rollers 16, 17 and the mutual distance thereof along the supporting shafts 36, 37 can be chosen based on size and mechanical features of the film 50 and/or parameters of the wrapping procedure requested (stretch percentage, wrapping force, etc.).

The first supporting shaft 36 and the second supporting shaft 37 are preferably motor-powered, i.e. they are rotated around their respective longitudinal axes Y1, Y2 (with opposite rotational directions) for example by an electric motor and a motion transmission assembly of a known type and not illustrated in the figures.

Alternatively, the first supporting shaft 36 and the second supporting shaft 37 can be mounted idle and rotated by the film 50, moved through the pleating rollers 16, 17, in particular dragged along the movement direction A by the two pre-stretching rollers 3, 4.

The first supporting shaft 36 and the second supporting shaft 37 are rotatably fixed to the supporting means 2.

A variant of the unwinding apparatus 1 of the invention not illustrated in the figures is also provided, wherein one or both of the supporting shafts 36, 37 are mounted on the supporting means so as to be movable between the operating configuration W, in which the first pleating rollers 16 and the second pleating rollers 17 are in contact to make the pleats 51 on the film 50, and a non-operating configuration, in which the first pleating rollers 16 and the second pleating rollers 17 are spaced apart from each other and from the film 50.

The unwinding apparatus 1 also comprises a pair of pressure rollers 18, 19 that are interposed between the pleating system 5 and the pre-stretching rollers 3, 4, rotatable about respective longitudinal axes Y3, Y4 parallel to each other and to the movement plane B of the film 50 and configured to press the film 50 from both sides, and in particular press and crush the pleats 51 made by the pleating system 5.

The pressure rollers 18, 19 can be motor-powered, i.e. they can be rotated about the respective longitudinal axes Y3, Y4 (with opposite rotational directions) by an electric motor and by a motion transmission assembly of known type and not illustrated in the figures.

Alternatively, the first supporting shaft 36 and the second supporting shaft 37 can be mounted idle and then rotated by the film 50 itself, moved through the pleating rollers 16, 17, in particular dragged along the movement direction A by the two pre-stretching rollers 3, 4.

One of the pre-stretching rollers 3, 4 or both of the pre-stretching rollers 3, 4 are provided internally with heating means adapted to heat to a defined temperature the external cylindrical surface of the pre-stretching rollers 3, 4 around which the film 50 is wrapped.

The pleating system 5 may comprise: at least one ultrasonic sensor, for example with direct diffusion, for detecting a possible breakage of the film; at least one fixed optical sensor, for example a polarized reflection photocell, for recording the height variations of the film 50 due to the pleating; a movable optical sensor, for example a so-called "m-thick" sensor, for detecting the execution of the pleating by measuring the thickness of the film 50; and a force sensor, for example with bending load cells, for recording the tensions exerted by the film 50 on the pleating rollers 16, 17.

Figure 5:
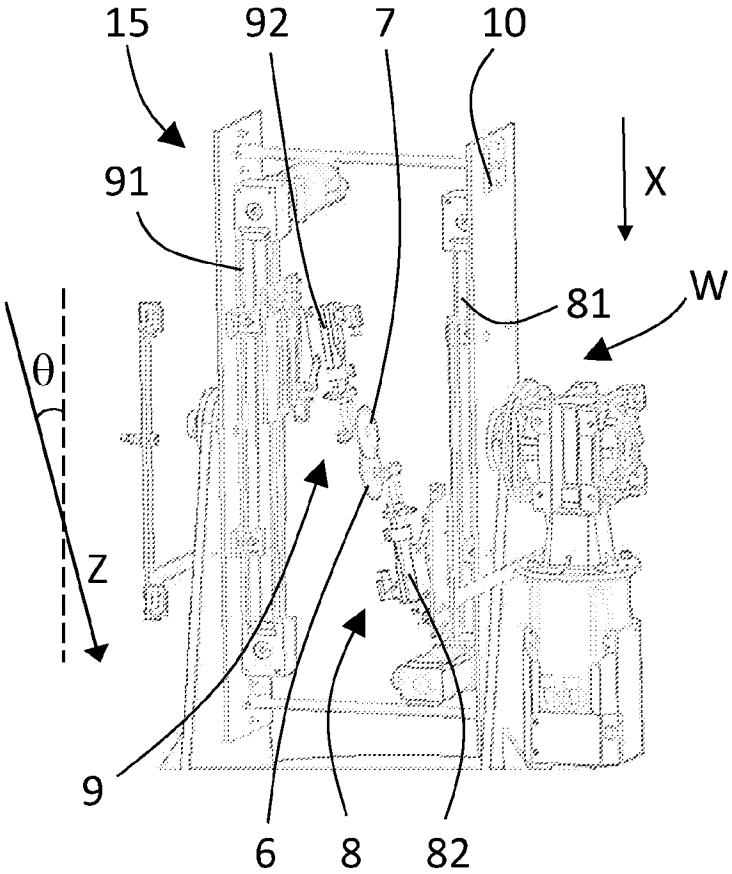
FIG. 5 is a perspective view of a variant of the pleating system in an operating position.
Figure 6:
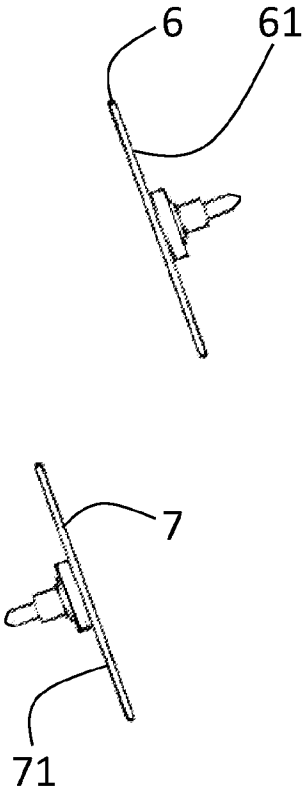
FIG. 6 is an enlarged and partial side view of pleating wheels of the pleating system of FIG. 5.
Figure 7:
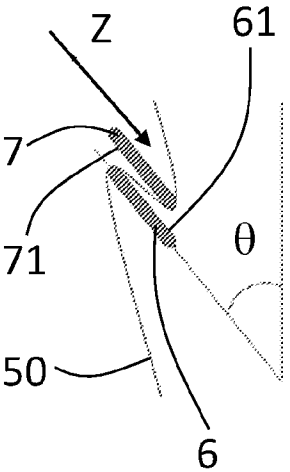
FIG. 7 is a partial and enlarged schematic view of the pleating wheels of FIG. 6 acting on the film of extensible material.

Referring to FIGS. 5-7, a variant of the unwinding apparatus 1 of the invention is illustrated which differs from the embodiment above described for the pleating system 15, which includes a supporting frame 10 connected to the supporting means 2 and two pleating devices 6, 7, each of which connected to a respective movement system 8, 9. Each movement system 8, 9 comprises respective vertical linear guide means 81, 91 and angular translation means 82, 92 which are connected to the respective vertical linear guide means 81, 91.

The two pleating devices are for example two pleating wheels 6, 7 made of low or zero friction material, for example PVC, having minimum thickness, with reduced axial dimension and diameter related to the pleats 51 to be made on the film 50.

The vertical linear guide means 81, 91 can be chosen among an endless screw system, a rack-pinion system and belt means. The angular translation means 82, 92 can be chosen between a servomotor system for the direct control of the angle and a linear motion sliding block system.

The vertical linear guide means 81, 91 are fixed to vertical walls of the supporting frame 10, the two vertical walls facing each other and intended to slidably support and guide the angular translation means 82, 92 along an adjustment direction X, in particular orthogonal to the movement direction A of the film 50. The angular translation means 82, 92 are in turn intended to slidably support and guide the respective wheel 6, 7 along an interaction direction Z, in particular inclined by an angle θ with respect to the adjustment direction X. Thereby the wheels 6, 7 are positioned facing each other and capable to slide both along the adjustment direction X and along the interaction direction Z. In particular, each wheel is provided with a respective rear wall 61, 71 facing the respective vertical linear guide means 81, 91.

In a non-operating configuration, the angular translation means 82, 92 and therefore the two wheels 6, 7 are positioned spaced apart from each other, in particular at a distance greater than the band width of the film 50, so that the latter can be freely unwound from the reel 60 to the pre-stretching rollers 3, 4.

In an operating configuration W, illustrated in FIG. 5, the vertical linear guide means 81, 91 move the respective angular translation means 82, 92 closer together and the angular translation means 82, 92 move the two wheels 6, 7 closer to each other so that the two rear walls 61, 71 face each other and the film 50 follows the profile of said rear walls forming two folds and three sections of the film 50 are overlapped, making the pleat 51. The film 50 with the pleat 51 slides towards the pre-stretching rollers 3, 4 and here, during the stretching step, the welding of the pleat 51 occurs.

The unwinding apparatus 1 is capable of implementing the wrapping method of the invention comprising:

- unwinding a film 50 of extensible material from a reel 60;
- making at least one pleat 51 on the film 50 by means of a pleating system 5, the pleat being parallel to a movement direction A of the film 50;
- stretching the film 50 by means of a pair of pre-stretching rollers 3, 4;
- welding the at least one pleat 51 by means of at least one of said pair of pre-stretching rollers 3, 4;
- wrapping the load with the film 50 provided with the pleat 51.

The method of the invention further comprises, before said stretching, pressing the film 50 provided with the pleat 51 by means of a pair of pressure rollers 18, 19.

The method comprises making a plurality of parallel and spaced apart pleats 51 on the film 50.

The unwinding apparatus 1 and the wrapping method of the invention allow any type of load to be wrapped firmly and steadily, reducing and virtually eliminating the risk of breakage of the film, strip, band during the wrapping. In fact, the welded pleats 51 made on the film 50 form respective longitudinal reinforcing strips which increase the resistance to tensile stress of the film 100 and prevent the propagation in the transverse direction of cuts, rips, tears and thus prevent the partial or complete breakage of the film.

The invention claimed is:

1. A method for wrapping a load with a film or strip or band of extensible material, comprising:

unwinding said film of extensible material from a reel;

making at least one pleat on the film by means of a pleating system, said pleat being parallel to a movement direction of said film;

stretching said film by means of a pair of pre-stretching rollers;

welding the at least one pleat by means of at least one of said pair of pre-stretching rollers;

wrapping the load with the film provided with said pleat.

2. The method according to claim 1, comprising, before said stretching, pressing said film provided with said at least one pleat by means of a pair of pressure rollers.

3. The method according to claim 1, comprising making a plurality of parallel and spaced apart pleats on said film.

4. An unwinding apparatus associable with a wrapping machine and arranged to deliver a film or strip or band of extensible material unwound from a reel, comprising:

a pair of pre-stretching rollers arranged to unwind and pre-stretch said film;

a pleating system positioned upstream of said pre-stretching rollers with respect to a movement direction of the film and configured to make at least one pleat parallel to said movement direction on the film;

wherein at least one of said pair of pre-stretching rollers is heatable so as to weld said at least one pleat.

5. The unwinding apparatus according to claim 4, wherein said pleating system comprises at least a first pleating roller and a second pleating roller mounted facing each other respectively on a first supporting shaft and a second supporting shaft that are rotatable and parallel to each other and to a movement plane of said film, said first pleating roller and said second pleating roller being arranged on opposite sides of said film and having respective truncated conical portions configured and arranged so as to be in contact with and engage each other in an operating configuration of said pleating system so as to press and fold said film and make a respective pleat.

6. The unwinding apparatus according to claim 5, wherein said first pleating roller and said second pleating roller comprise respective external walls inclined by a pleating angle with respect to said movement plane.

7. The unwinding apparatus according to claim 6, wherein said pleating angle is substantially comprised between 30° and 70°.

8. The unwinding apparatus according to claim 5, wherein said first pleating roller further comprises an annular portion configured to abut a side wall of the truncated conical portion of said second pleating roller so as to press and fold said film against said side wall.

9. The unwinding apparatus according to claim 5, wherein said first supporting shaft and said second supporting shaft are motor-powered.

10. The unwinding apparatus according to claim 5, wherein said pleating system comprises a plurality of first pleating rollers and a corresponding plurality of second pleating rollers mounted on said first and second supporting shaft and arranged to make a plurality of respective pleats on said film.

11. The unwinding apparatus according to claim 4, comprising a pair of pressure rollers interposed between said pleating system and said pre-stretching rollers, parallel to each other and to a movement plane of said film and configured to press said film and/or said pleat.

12. The unwinding apparatus according to claim 11, wherein said pressure rollers are motor-powered.

13. The unwinding apparatus according to claim 4, wherein said pleating system comprises a supporting frame and two pleating devices, each pleating device being connected to a respective movement system of the pleating system and adapted to interact with the other folding device in order to make said pleat of the film in an operating configuration.

* * * * *